US007712687B2

(12) United States Patent
Wilson et al.

(10) Patent No.: US 7,712,687 B2
(45) **Date of Patent: *May 11, 2010**

(54) ELECTROSTATIC SPRAY DEVICE

(75) Inventors: David Edward Wilson, Reisterstown, MD (US); Bryan Michael Kadlubowski, Manchester, MD (US); Jeffrey Keith Leppla, Baltimore, MD (US); Wataru Hirose, Kyoto (JP); Yoshihiro Wakiyama, Uji (JP); Takeshi Aoyama, Uji (JP); Takeshi Mori, Uji (JP); Toru Sumiyoshi, Ashiya (JP)

(73) Assignee: The Procter & Gamble Company, Cincinnati, OH (US)

( * ) Notice: Subject to any disclaimer, the term of this patent is extended or adjusted under 35 U.S.C. 154(b) by 1173 days.

This patent is subject to a terminal disclaimer.

(21) Appl. No.: 09/759,552

(22) Filed: Jan. 12, 2001

(65) Prior Publication Data

US 2001/0020653 A1 Sep. 13, 2001

Related U.S. Application Data

(63) Continuation-in-part of application No. 09/377,332, filed on Aug. 18, 1999, now Pat. No. 6,318,647, and a continuation-in-part of application No. 09/377,333, filed on Aug. 18, 1999, now Pat. No. 6,311,903.

(51) Int. Cl.
*B05B 5/00* (2006.01)

(52) U.S. Cl. ..... 239/691; 239/690; 239/690.1; 239/692; 239/706; 239/708

(58) Field of Classification Search ..... 239/690, 239/690.1, 691, 692, 693, 694, 695, 696, 239/697, 698, 699, 700, 706, 708, 332
See application file for complete search history.

(56) References Cited

U.S. PATENT DOCUMENTS 2,159,894 A 5/1939 Hines ..... 299/89

(Continued)

FOREIGN PATENT DOCUMENTS

DE 29910321 5/1999

(Continued)

*Primary Examiner*—Dinh Q Nguyen
(74) *Attorney, Agent, or Firm*—Vladimir Vitenberg; Megan C. Hymore; S. Robert Chuey

(57) ABSTRACT

An electrostatic spray device that maintains a consistent charge-to-mass ratio in order to maintain a consistent target spray quality is disclosed. During steady state conditions, the high voltage power supply adjusts the output voltage level in response to changing environmental and/or operating conditions. During transient conditions such as start-up, shut-down and changing flow rate conditions, the high voltage power supply ensures that the charge-to-mass ratio is maintained. During, start-up, for example, the high voltage power supply charges the high voltage electrode to a predetermined voltage level before the product is delivered to the charging location. During shut-down, the product delivery is stopped before the high voltage power supply shuts off power to the high voltage electrode, and during changes in product flow rate, the voltage level of the high voltage electrode is adjusted to maintain a consistent charge-to-mass ratio. The present invention also prevents afterspray by discharging the stored charge remaining in storage elements of the high voltage power supply.

16 Claims, 4 Drawing Sheets

U.S. PATENT DOCUMENTS

| | | | | | |
|---|---|---|---|---|---|
| 2,629,516 | A | | 2/1953 | Badham | 222/79 |
| 3,012,969 | A | | 12/1961 | van der Minne et al. | 252/153 |
| 4,000,443 | A | | 12/1976 | Lever | |
| 4,079,894 | A | | 3/1978 | Harjar et al. | 239/526 |
| 4,122,845 | A | | 10/1978 | Stouffer et al. | 128/66 |
| 4,143,819 | A | | 3/1979 | Hastings | 239/707 |
| 4,194,696 | A | | 3/1980 | Harjar | 239/707 |
| 4,216,915 | A | * | 8/1980 | Hengartner et al. | 239/698 |
| 4,258,073 | A | | 3/1981 | Payne | 427/1 |
| 4,266,262 | A | * | 5/1981 | Haase, Jr. | 361/228 |
| 4,331,298 | A | * | 5/1982 | Bentley et al. | 239/690 |
| 4,380,786 | A | * | 4/1983 | Kelly | 361/228 |
| 4,549,243 | A | | 10/1985 | Owen et al. | |
| 4,561,037 | A | | 12/1985 | MacLaine et al. | 361/228 |
| 4,577,803 | A | | 3/1986 | Owen | 239/690 |
| 4,630,169 | A | * | 12/1986 | Kelly | 361/225 |
| 4,907,727 | A | | 3/1990 | Ernst et al. | 222/386.5 |
| 5,059,766 | A | * | 10/1991 | Gilliland | 219/130.21 |
| 5,105,984 | A | | 4/1992 | Kazimir | 222/103 |
| 5,221,050 | A | | 6/1993 | Jeffries et al. | 239/708 |
| 5,222,663 | A | | 6/1993 | Noakes et al. | 239/3 |
| 5,229,105 | A | | 7/1993 | Wilmsmann | 424/59 |
| 5,268,166 | A | | 12/1993 | Barnett et al. | 424/47 |
| 5,292,067 | A | | 3/1994 | Jeffries et al. | 239/3 |
| 5,296,681 | A | | 3/1994 | Tschauder | 219/410 |
| 5,322,684 | A | | 6/1994 | Barnett et al. | 424/47 |
| 5,405,090 | A | | 4/1995 | Greene et al. | 239/708 |
| 5,422,630 | A | | 6/1995 | Quinn et al. | 340/661 |
| 5,468,488 | A | | 11/1995 | Wahi | 424/78.03 |
| 5,490,633 | A | | 2/1996 | Jeffries et al. | 239/691 |
| 5,494,674 | A | | 2/1996 | Barnett et al. | 424/401 |
| 5,519,159 | A | | 5/1996 | Narabe et al. | 558/169 |
| 5,531,384 | A | | 7/1996 | Greene et al. | |
| 5,566,042 | A | * | 10/1996 | Perkins et al. | 361/228 |
| 5,662,890 | A | | 9/1997 | Punto et al. | 424/59 |
| 5,674,481 | A | | 10/1997 | Wahi | 424/78.03 |
| 5,732,884 | A | | 3/1998 | Jauner | 239/288.3 |
| 5,779,162 | A | * | 7/1998 | Noakes et al. | 239/690.1 |
| 5,922,131 | A | * | 7/1999 | Haas | 118/629 |
| 5,972,417 | A | * | 10/1999 | Perkins et al. | 427/8 |
| 6,595,208 | B1 | * | 7/2003 | Coffee et al. | 128/203.12 |
| 6,866,212 | B2 | * | 3/2005 | Sumiyoshi et al. | 239/690 |

FOREIGN PATENT DOCUMENTS

| | | | |
|---|---|---|---|
| EP | 0 057 324 | A | 8/1982 |
| GB | 2 273 673 | A | 6/1994 |
| GB | 2 273 872 | A | 7/1994 |
| JP | 10-146216 | | 6/1998 |
| SU | 867927 | | 9/1981 |
| WO | 94/11119 | | 5/1994 |
| WO | 94/27560 | | 12/1994 |
| WO | 95/29758 | | 11/1995 |
| WO | 96/10459 | | 4/1996 |
| WO | 96/11062 | | 4/1996 |
| WO | 96/40441 | | 12/1996 |
| WO | 97/33527 | | 9/1997 |
| WO | 98/18561 | | 5/1998 |
| WO | WO 98/18561 | A | 5/1998 |

* cited by examiner

ELECTROSTATIC SPRAY DEVICE

CROSS-REFERENCE TO RELATED APPLICATION

This application is a continuation-in-part of our earlier applications, U.S. Ser. No. 09/377,332, filed on Aug. 18, 1999 now U.S. Pat. No. 6,318,647 and U.S. Ser. No. 09/377,333, filed on Aug. 18, 1999 now U.S. Pat. No. 6,311,903.

THE FIELD OF INVENTION

This invention relates to a portable electrostatic spray device designed for personal use. More particularly, this invention relates to a portable electrostatic spray device designed for personal use that provides superior spray quality.

BACKGROUND OF THE INVENTION

Known portable electrostatic spray devices often suffer from poor, inconsistent spray quality when the charge-to-mass ratio of the product varies outside of a predetermined range. This may occur during transient conditions such as start-up and shut-down, or during steady state conditions such as when environmental conditions vary the load seen by the electrostatic spray device. In start-up conditions, for example, if the electrostatic spray device is allowed to begin spraying before the power supply circuit has fully charged the electrode to a desired potential, then the charge-to-mass ratio of the resulting spray may be below a desired level and may result in a poor quality spray exhibiting larger than desired droplet sizes and uneven spray patterns. Alternatively, after the electrostatic spray device has been turned off, charge stored in capacitive elements of the device may still be present and result in an after-spray condition until the charge in the capacitive elements has dissipated enough to stop a continuing flow of product from the nozzle of the electrostatic spray device. Further, during operation changes in environmental conditions such as humidity may significantly change the load seen by the high voltage power supply. Changes in the load will also affect the charge-to-mass ratio of the product and will alter the characteristics of the product spray.

U.S. Pat. No. 4,549,243 issued to Owen (the "Owen reference") describes an electrostatic spraying apparatus that can be held in the human hand for applications such as graphic work where it is desired that the area to which the spray is applied can be precisely controlled (Col 1,11 5-9). A feature of the device disclosed in the Owen reference is that provisions may be made with said device for varying the potential applied to the nozzle, for example by varying the generator output, e.g. the frequency of production of high voltage pulses and/or their magnitude. The Owen reference discloses that this is advantageous since it enables fine, narrow, sprays to be produced (Col. 6, 11 37-42). Although the Owen reference does recognize a benefit for changing the output of the high voltage generator, the reference does not disclose sensing a spray load and adjusting the output of a high voltage power supply in response to a changing spray load. Nor does the Owen reference disclose providing user adjustable flow rates or for synchronizing the output of the high voltage power supply with the product flow rate to consistently obtain an optimal charge-to-mass ratio.

U.S. Pat. No. 5,121,884 issued to Noakes (the "Noakes reference") presents an electrostatic sprayer designed such that potential surface leakage paths along which current may leak from the HT generator are sufficiently long to allow the use of a generator having a smaller than conventional maximum current output (Abstract). The benefit of reducing the current output required from the generator enables it to be built less expensively (Col 1, 11 12-14). Further, the Noakes reference identifies that the majority of the current supplied by the high voltage generator is surface leakage and unwanted corona discharge, only a portion being current actually used to charge the spray (Col 1, 11 33-37). The solution set forth by Noakes is to limit the surface leakage paths and to account for the leakage current in the current produced by the HT generator. An inherent problem with predicting the losses from the HT generator arises when operating a device in varying atmospheric conditions. With a change in atmospheric conditions (e.g. increased humidity) loses associated with corona discharge and surface leakage can either increase or decrease. To ensure that a particular device is capable of operation in a variety of atmospheric conditions, the device would need to be designed to function in the worst possible atmospheric condition (i.e. atmospheric condition corresponding with the highest corona discharge or surface leakage current). This would require operating a power supply for the worst case atmospheric condition thereby generating a significant amount of extra energy in atmospheric conditions that are not the worst case atmospheric conditions. Operating the power supply in this manner leads to an excess drain on battery power and increasing the possibility of charge build-up within the device leading to increased shock potential.

SUMMARY OF THE INVENTION

The present invention provides an electrostatic spray device that maintains a consistent charge-to-mass ratio in order to maintain a consistent target spray quality. During steady state conditions, the high voltage power supply adjusts the output voltage level in response to changing environmental and/or operating conditions. During transient conditions such as start-up, shut-down and changing flow rate conditions, the high voltage power supply ensures that the charge-to-mass ratio is maintained. During, start-up, for example, the high voltage power supply charges the high voltage electrode to a predetermined voltage level before the product is delivered to the charging location. During shut-down, the product delivery is stopped before the high voltage power supply shuts off power to the high voltage electrode, and during changes in product flow rate, the voltage level of the high voltage electrode is adjusted to maintain a consistent charge-to-mass ratio. The present invention also prevents afterspray by discharging the stored charge remaining in storage elements of the high voltage power supply.

DETAILED DESCRIPTION OF THE PREFERRED EMBODIMENT

A first step in the design of a typical electrostatic spray device starts with identifying the target spray quality for a particular product or application. "Target spray quality" is defined as the combination of one or more of the following: spray droplet diameter, distribution of spray droplet diameter, swath width, and spray diameter. In any particular application, a combination of one, more than one, or all of the above mentioned variables may be needed to define a target spray quality for that application.

To achieve a target spray quality, the output operating variables of the device (e.g. high voltage output, current output, product flow rate) are balanced with a unique set of fluid or product properties (e.g. viscosity, resistivity, surface tension). For a given set of environmental (e.g. temperature, humidity), device operating variables, and fluid properties, a particular charge-to-mass ratio exists for a specific target spray quality. The charge-to-mass ratio is a measure of the amount of electrical charge carried by the atomized spray on a per weight basis and may be expressed in terms of coulombs per kilogram (C/kg). The charge-to-mass ratio provides a useful measure to ensure that the target spray quality is maintained. A change during spraying in any of the fluid properties or device output operating variables will result in a change in the spray quality. This change in spray quality corresponds to a change in the charge-to-mass ratio.

In one aspect of this invention, the electrostatic spray device reacts to changes in environmental and/or operating conditions during steady state operating conditions in order to maintain an optimal charge-to-mass ratio and, thus, maintain an acceptable spray quality. Changes in environmental and/or operating conditions tend to affect the available energy for spray formation due to losses of energy to the atmosphere; typically in the form of increased corona and surface leakage. Generally, in a more humid environment, energy losses that occur at the high voltage electrode increase. For instance, in a high humidity environment such as a bathroom, the energy available at the high voltage electrode is less than would be available in a lower humidity environment because of the increased corona losses and surface leakage. This results in a lower charge-to-mass ratio for a product spray, and may result in an inconsistent spray quality if the device does not react to the environmental and/or operating condition.

Figure 1:
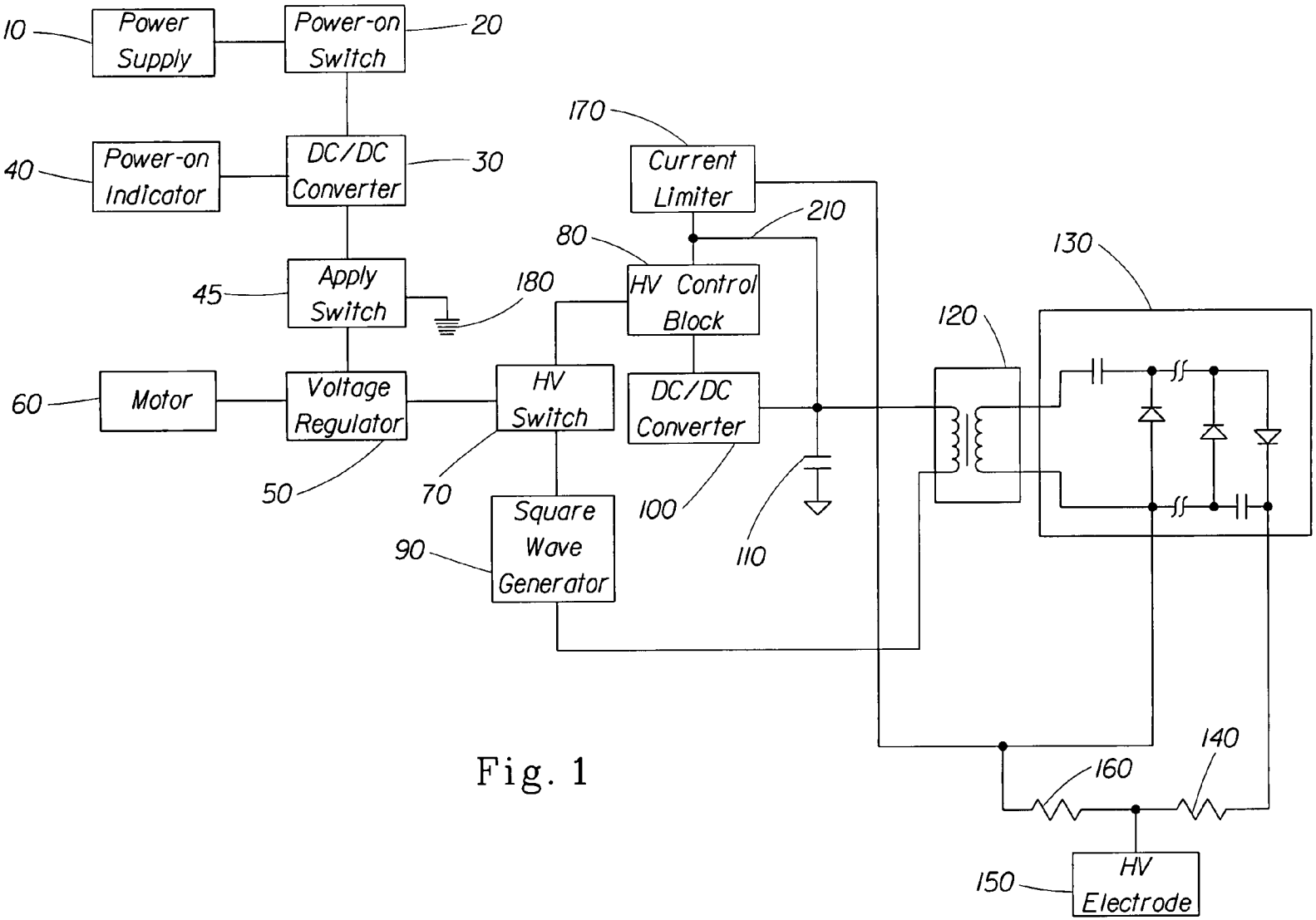
FIG. 1 is a schematic view of the electrical circuitry of one embodiment of an electrostatic spray device of the present invention.

FIG. 1 shows an electrical schematic of one embodiment of an electrostatic spraying device. The power source 10 shown can be a battery or other power source known in the art. For example, the power source can be one or more user replaceable battery such as two standard "AAA" batteries. Alternatively, the power source could be user-rechargeable cells, a non-user serviceable rechargeable power pack, or an external source (i.e. "line" supply). In at least one arrangement of the circuitry, power source 10 can be separated from the rest of the circuit by a power switch 20. The power switch 20 can extend the active life of a self-contained power source 10 such as a battery. The power switch 20 can also add a margin of safety to a line-voltage power supply by supplying power to the remainder of the circuit only when the power switch 20 is closed. In one embodiment, the power switch 20 can be a toggle switch that is able to maintain its setting until a later actuation. When switch 20 is turned to the "on" position, power is supplied to the DC/DC Converter 30.

The DC/DC Converter 30 receives an input voltage supply from power source 10, for example, a nominal 3.0 volt supply from two conventional "AAA" type batteries, and converts that to a higher voltage signal such as a 5.0 volt supply. The DC/DC Converter 30 can be, for example, a 3 to 5 V DC converter available from Linear Technology Corporation (Part number LT1317BCMS8-TR). The DC/DC Converter 30 can also be used to send a signal to indicator 40. This signal can be either a portion of the supply signal from power source 10, or a portion of the output signal, for example 5.0 volts. The indicator 40, for example, can be an LED that emits light in the orange range of the visible electromagnetic (EM) spectrum. As shown in FIG. 1, the indicator 40 can be arranged to emit visible light only when the power switch 20 is in the "on" position and sufficient voltage is supplied to the indicator 40 from DC/DC Converter 30. A user controlled apply switch 45 can be depressed or turned to the "on" position, depending on the type of switch employed, to complete the power supply circuit and provide power to the voltage regulator 50. The voltage regulator 50 can control the input voltage to a motor 60, if necessary. The nominal voltage output from the voltage regulator can be about 3.3 volts. The voltage regulator 50 can also send an output signal to the high voltage switch 70. The high voltage switch 70, for example, can be a transistor or diode element such as a transistor from NEC Corporation part number 2SA812.

The high voltage switch 70 supplies power to the remaining high voltage generation circuitry in response to a signal from the voltage regulator 50. The high voltage switch 70 sends a signal to both high voltage control block 80 and a signal generator such as square wave generator 90. The high voltage control block 80 compares a signal from storage capacitor 110 and current limiter 170 to an internally set reference voltage. Depending upon the value of the feedback signal from storage capacitor 110 and/or a signal from the current limiter 170, the high voltage control block 80 will send either an "ON" or an "OFF" signal to the DC/DC converter 100. The high voltage control block 80, for example, can be an op-amp such as Toshiba Corporation part number TC75W57FU.

The DC/DC converter 100 converts a lower input voltage to a higher output voltage. For example, the DC/DC converter 100 can convert a nominal input voltage of about 5.0 volts to a higher nominal output voltage of about 25.0 volts. The output from the DC/DC converter 100 charges the storage capacitor 110. The storage capacitor 110 provides an input voltage to the primary coil of the high voltage transformer 120. The frequency of the higher voltage output of DC/DC converter 100 is controlled, as described in more detail later, by a feedback loop to ensure that a substantially constant supply, such as about a 25.0 volts supply, is available to the high voltage transformer 120 from the storage capacitor 110. The DC/DC converter 100 can be, for example, a DC/DC Converter from Toshiba Corporation such as part number TC75W57FU. The high voltage switch 70 can also send an "ON" signal to the square wave generator 90, which is also connected to the primary coil of the high voltage transformer 120. This results in about a 25.0 volt peak to peak AC pulses being generated through the primary coil of the high voltage transformer 120. The square wave generator 90 can be, for example, an op-amp element from Toshiba Corporation such as part number TC75W57FU. The turn ratio of the high voltage transformer 120 can be, for example, about 100:1 such that an input voltage of about 25.0 volt at the primary coil would result in about a 2.5 kV (2500 volt) output voltage from the secondary coil. The output voltage from the high voltage transformer 120 can then be supplied to a voltage multiplier 130.

The voltage multiplier 130 rectifies the output signal from the high voltage transformer 120 and multiplies it to provide a higher voltage DC output voltage. If the output voltage of the high voltage transformer 120 is about a 2.5 kV AC signal, for example, the voltage multiplier 130 could rectify this signal and multiply it to provide a higher voltage DC output such as a 14.0 kV DC output voltage. In one embodiment, the voltage multiplier 130 can be a six stage Cockroft-Walton diode charge pump. A stage for a Cockroft-Walton diode charge pump is commonly defined as the combination of one capacitor and one diode within the circuit. One skilled in the art would recognize that the number of stages needed with a voltage multiplier is a function of the magnitude of the input AC voltage source and is dependent upon the required output voltage. In one embodiment, the high voltage transformer 120 and the voltage multiplier 130 can be encapsulated in a sealant such as a silicon sealant such as one available from Shin-Etsu Chemical Company, Ltd. as part number KE1204(A.B) TLV. By encapsulating the high voltage transformer 120 and the voltage multiplier 130 in the sealant, the electrical leakage and corona discharge from these high voltage components can be reduced to increase their efficiency.

A current limiting resistor 140 can be located between the output of high voltage multiplier 130 and the high voltage electrode 150. The current limiting resistor 140 can be used to limit the current output from the high voltage multiplier 130 available to the high voltage electrode 150. In one particular embodiment, the current limiting resistor 140 could be, for example, about 20 megaohms. One skilled in the art would recognize, however, that if a higher output current is desired, then a current limiting resistor with a lower resistance would be desired. Conversely, if a lower output current is desired, then a current limiting resistor with a higher resistance would be desired. The high voltage electrode 150 can be made from a suitable metal or conductive plastic, such as acrylonitrile butadiene styrene (ABS) filled with 10% carbon fibers. A bleeder resistor 160, which is described in more detail below, can also be connected as shown in FIG. 1. The current limiter 170 is also connected to the output circuitry of the high voltage multiplier 130.

A ground contact 180 can also be provided to establish a common ground between the circuitry of the electrostatic spraying device and the user in order to reduce the risk of shocking the user. Further, in personal care applications, the ground contact 180 can also prevent charge from building-up on the skin of the user as the charged particles accumulate on the skin of the user. The ground contact 53 can be integrated into apply switch 45 and/or substantially adjacent to apply switch 45 such that the user cannot energize the motor 60 and the high voltage supply circuitry without simultaneously grounding themselves to the device. For example, the apply switch 45 can be made of metal and/or the ground contact can be a conductive contact or a grounding electrode can be located next to apply switch 45.

Steady-State Operating Conditions

In the embodiment of the present invention shown in FIG. 1, the high voltage control block 80 along with feedback control loop 210 provide a control circuit that reacts to changes in environmental and/or operating conditions. In this embodiment, the high voltage control block 80 is designed with the feedback loop 210 to track and adjust the operation of the high voltage generating circuitry, i.e., the high voltage transformer 120 and the voltage multiplier 130. The feedback loop 210 monitors or tracks the voltage drop in the power supplied to the primary coil of the high voltage transformer 120 such as by monitoring the voltage drop across the storage capacitor 110. The voltage drop across the storage capacitor 110 between switching cycles of the square wave generator 90 is proportional to the voltage drop at the voltage multiplier 130 and to the voltage drop at the high voltage electrode 150. When the voltage at high voltage electrode 150 drops in response to a spray load, for example, the voltage drop is also seen proportionately in the voltage multiplier 130 and also in the storage capacitor 110 between switching cycles. Thus, the feedback loop 210 can track changes in environmental and/or operating conditions that cause a change in the voltage level at the high voltage electrode 150 by monitoring the voltage level at the storage capacitor 110. The high voltage control block 80 includes a control circuit that compares the signal from the feedback loop 210 to a reference voltage and controls the operation of the DC/DC converter 100 such as through frequency modulation, pulse width modulation or any other control method know in the art. The control circuit may include, for example, an op-amp circuit using an op-amp such as Toshiba Corporation's part number TC75W57FU. In one embodiment, the high voltage control block 80 may provide a steady signal to the DC/DC converter 100 when the signal from the feedback loop 210 is within a predetermined range. When the DC/DC converter 100 receives the steady signal, the DC/DC converter 100 may continue to operate at a predetermined frequency. However, when the signal from feedback loop 210 is outside of the predetermined range (e.g., excess losses at the high voltage electrode 150 due to high humidity), the high voltage control block 80 changes the control signal to the DC/DC converter 100, which adjusts the charge frequency of the DC/DC converter 100 in order to bring the voltage level of the storage capacitor 110 back within the predetermined range. This results in an increased or decreased current supply to the high voltage generating circuitry, i.e. high voltage transformer 120 and the voltage multiplier 130, in order to maintain the desired voltage under varying environmental and/or operating conditions. One skilled in the art would also recognize that feedback loop may monitor the operating conditions of the circuit at other locations such as at the secondary coil of the high voltage transformer 120, within the voltage multiplier 130, at the current limiting resistor 140, at the high voltage electrode 150, etc.

By varying the current provided to the high voltage generating circuitry depending upon the environmental and/or operating conditions, the present invention reduces the production of excess energy during periods of low spray loading while at the same time providing optimal spray performance over a wide range of environmental and operating conditions. This allows for more efficient use of stored energy and may increase the usable life of a replaceable battery power source. Further, by reducing the current level during periods of low spray loading, the electrostatic spray device of the present invention can reduce corona leakage, which potentially leads to spark discharges and electrical shocking of the user.

In yet another aspect of the present invention, the device internals may be encased in a moisture-proof barrier in order to improve spray performance during operation in high humidity environments. The barrier prevents atmospheric moisture from penetrating the device and coming in contact with the high voltage components located inside of the device. This reduces corona discharge and other losses associated with the increased humidity, thereby maintaining the target spray quality. An electrostatic spray device or cartridge, for example, may be sealed around the external portions of the device or cartridge with a barrier layer such as an elastomer such as Surilyn.

Transient Conditions

Another aspect of this invention is maintaining the optimal charge-to-mass ratio during transitory conditions, e.g., during start-up, shut-down or varying product flow rates. During startup, for example, an electrostatic spray device of the present invention can synchronize the charging of the high voltage generating circuitry and the delivery of product to the charging location. This prevents the product from being sprayed until the product can be charged enough to provide the desired charge-to-mass level of the product so that the device can provide a target spray quality. During shut-down, conversely, the electrostatic spray device can maintain the high voltage electrode at a sufficient potential in order to maintain a consistent charge-to-mass ratio until the product delivery to the charging condition has substantially stopped. This allows the device to provide a target spray quality until the device is shut down. During periods of varying product flow rates, however, an electrostatic spray device can also synchronize the output of the high voltage generating circuitry with the changing flow rate in order to maintain a consistent charge-to-mass ratio throughout the operation of the device. This allows the device to maintain a target spray quality even if the product flow rate varies.

Figure 6A:
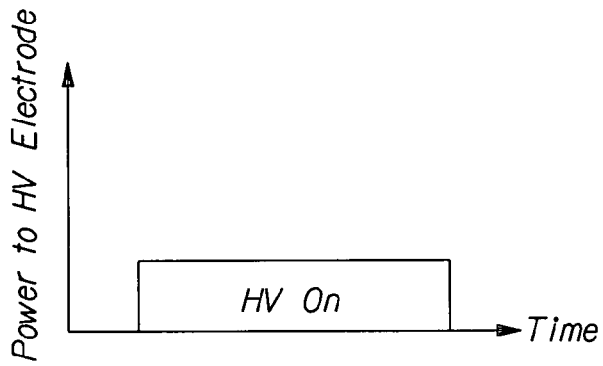
FIG. 6 is a graphical depiction of the operation of another embodiment of the present invention.
Figure 6B:
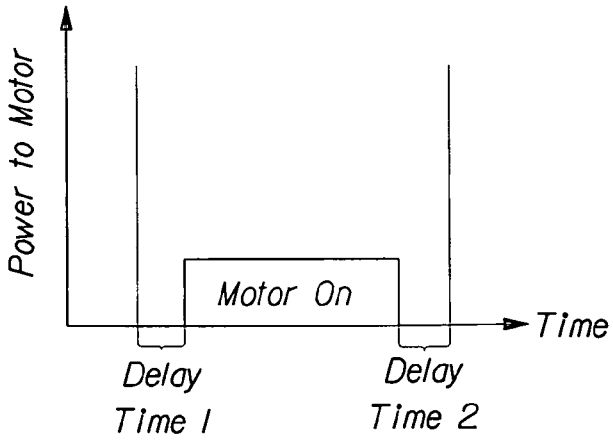

In one aspect of the present invention, such as shown in FIG. 6, the high voltage electrode 150 can be energized before power is supplied to the motor 60 that drives the product delivery system. In this embodiment, the product is not delivered to the high voltage electrode 150 until the potential of the electrode is sufficient to provide a consistent charge-to-mass ratio of the product spray. The elapsed time difference between the time the high voltage generating circuitry is turned on and the time that power is supplied to the motor driving the product delivery system is shown as Delay Time 1. By delaying the operation of the motor 60, the device is able to provide a spray formation at start-up that has the desired charge-to-mass ratio by preventing product delivery to the charging location before the charging location has substantially reached its target potential.

In another aspect of the invention, the device can continue to provide power to the high voltage electrode 150 until the product delivery to the charging location has been stopped. For example, a second delay, such as the Delay time 2 shown in FIG. 6, can be provided at shutdown. In this case, the high voltage generating circuitry is able to maintain the high voltage electrode 150 at the target potential until after the product delivery to the charging location has been stopped. The Delay Time 2 may allow for the electrode 150 to be kept at a sufficient potential to provide a consistent charge-to-mass ratio to charge the last of the product to be supplied such as when the product delivery system has a delay time associated with it or where the product being delivered has some momentum associated with it. In such a system, there may be a delay between when the power supply to the motor 60 is turned off and when the product stops moving towards the charging location. In this case it is desirable to maintain the power to the charging location until the product within the product delivery system has completely stopped. An electronic timer or delay element, for example, may be incorporated into the voltage regulator 50 to provide one or more delays such as Delay Time 1 and Delay Time 2.

Figure 7A:
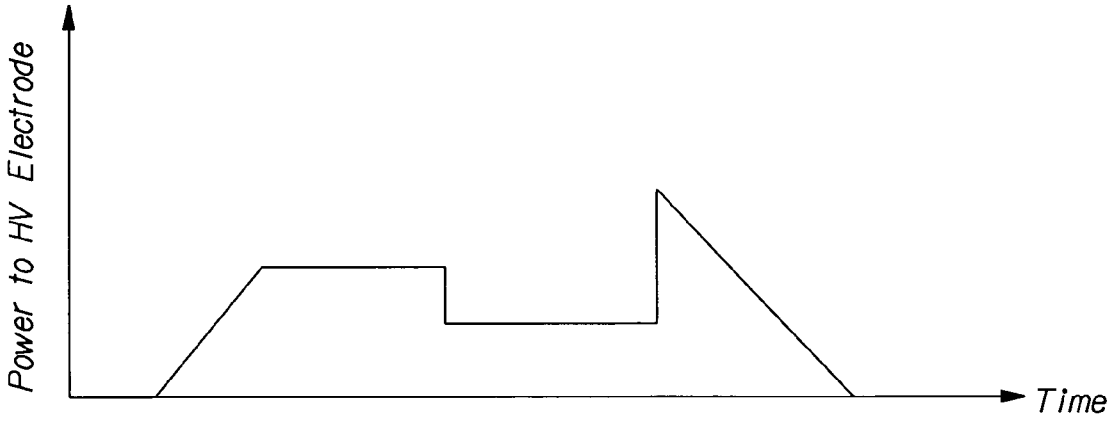
FIG. 7 is a graphical depiction of the operation of another embodiment of the present invention.
Figure 7B:
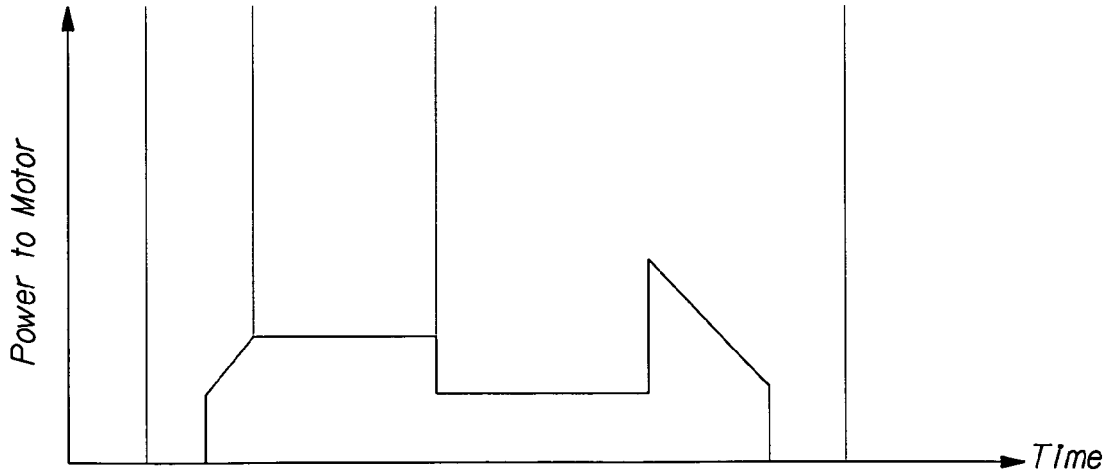

Yet another aspect of this invention is shown in FIG. 7, which depicts a synchronized power delivery to the high voltage electrode 150 and the motor 60 that corresponds to changing flow rates of the product being delivered to the electrode. By ramping up the high voltage generating circuitry, i.e., the high voltage transformer 120 and the voltage multiplier 130, along with the product delivery rate, an ideal charge-to-mass ratio can be maintained. For example, a flow rate sensor, a motor feedback circuit can be used to provide a feedback signal to the high voltage control block 80 that drives the high voltage generating circuitry. Alternatively, other methods known in the art to monitor or approximate the flow rate of the product can be used within the scope of the present invention. The high voltage control block 80 can then adjust the output of the high voltage generating circuitry so that it is proportional to the product flow rate, maintain the desired charge-to-mass ratio and ensure that the device is delivering a target spray quality.

A further aspect of this invention allows the electrostatic spray device to reduce after-spray. After-spray is defined as when the electrostatic spraying device momentarily continues to spray product after power has been shut down to the high voltage power supply. Electrostatic spray devices with integral high voltage power supplies typically use capacitor-diode ladders to step-up output voltage from a primary high voltage transformer. One suitable capacitor-diode ladder is a Cockroft-Walton type diode charge pump. Capacitors are also used in electrostatic spray circuitry to improve the quality in the high voltage output and to reduce variations or noise. After the user turns off the device, the capacitors function as electrical storage elements and store the high voltage charge until the charge is dissipated such as through corona leakage to the atmosphere or a spark discharge to a point having a lower electrical potential (e.g., a shock to a user). This stored charge can continue to provide power to the high voltage electrode 150 and may create enough of a potential difference between the product and nearby surfaces to allow for the product to spray after the power has been cut off to the high voltage power supply until the charge in the capacitors is sufficiently dissipated.

An after-spray condition is undesirable because the device continues to spray product after the user has turned off the device and the spray quality is inconsistent because the charge-to-mass ratio significantly varies. The desired charge-to-mass ratio is not maintained because there is not a consistent supply of high voltage current available to completely atomize the product into a spray. The charge stored within the device can partially atomize the product for a period of time while the charge dissipates to create an after-spray. Since the voltage supply to atomize the product is not constant, the charge-to-mass ratio of the resulting spray will vary resulting in the production of a spray that has varying spray quality. Further, the after-spray condition can produce a spray at an unintended time and/or location, such as continuing to spray after the user has placed the device in a purse or storage cabinet. This can create an unexpected and undesirable mess.

After-spray can be reduced or eliminated by rapidly discharging the capacitive elements after the power has been shut down to the high voltage power supply. In a first embodiment of this invention, a high voltage resistor, such as bleeder resistor 160 shown in FIG. 1, can be connected between the high voltage output electrode 150 and a point at a lower potential within the device. The bleeder resistor 160 can provide a path by which excess stored energy in the device, such as the energy stored in the capacitors within the voltage multiplier 130, can be dissipated in a relatively short period of time after the user has completed the spraying operation, thereby reducing the occurrence of after-spray. The bleeder resistor 160 should be selected to have a large enough resistance so that the impedance of bleeder resistor 160 will be significantly high when compared to the output current limiting resistor and the spray load so as to not dramatically effect the quality of spray or output of the high voltage generator during normal operation. If the value of bleeder resistor 160 is too low, bleeder resistor 160 will provide a path of lesser resistance than the resistance represented by the spraying operation. In this case bleeder resistor 160 will drain more current then desired during normal spraying operation. When the current passing through bleeder resistor 160 in normal spraying operation is too high, there will be insufficient current available for atomizing and charging the product. The bleeder resistor can further shorten the life of a portable power source such as a battery. The bleeder resistor 160 should, however, have a resistance low enough so as to allow for dissipation of stored energy in a relatively short period of time. The time needed to dissipate the stored energy of the device can be estimated by using the value of said capacitance multiplied by the value of bleeder resistor 160 to determine the value of an RC time constant. This relationship is given by:

$$\tau_A = C_D \times R_B$$

Where:

$\tau_A$=Time to drain approximately 63% of the stored capacitance from spraying device (sec)

$C_D$=Device capacitance (F)

$R_B$=Value of bleeder resistor (Ω)

This RC time constant, $\tau_A$, represents the approximate time required to dissipate approximately 63% of the charge of the storage device. The term $C_D$ represents a sum of the capacitance from conventional capacitor elements within the high voltage power supply circuit as well as capacitance of the product reservoir and other stray capacitance from within the device. Therefore, while applying this relationship, which has been adopted from conventional circuitry, it will be understood that in practice, $\tau_A$ represents a time in which greater than 63% of the stored charge is dissipated.

In some cases, the charge dissipated within $\tau_A$ is sufficient to reduce the charge within the device to a point where after-spray is reduced or eliminated. However, in some cases, the time $\tau_A$ may not be sufficient time to drain enough charge to reduce or completely eliminate after-spray. In these cases, the designer may desire to drain the entire stored charge from the within the device. In this case, it will be understood that the following relationship approximates a time, $\tau_B$, that will ensure complete dissipation of any stored charge. This relationship is given by:

$$\tau_B = 5 \times \tau_A = 5 \times C_D \times R_B$$

Where:

$\tau_B$=Time to drain 100% of the stored charge from the spraying device (sec)

$C_D$=Device capacitance (F)

$\tau_B$=Value of bleeder resistor (Ω)

One suitable range for a typical bleeder resistor is between about 1 MΩ and about 100 GΩ, another suitable range is between about 500 MΩ and about 50 GΩ, and yet another suitable range is between about 1 GΩ and about 20 GΩ. In one embodiment, for example, it may be desirable to completely drain the stored charge of the power supply in less than about 60 seconds, preferably in less than about 30 seconds, and most preferably in less than about 5 seconds. Using an example to illustrate, if it is desirable to dissipate at least about 63% of the stored charge of an electrostatic spraying device having a capacitance of about 500 pF (the device capacitance can be estimated by the sum of the capacitance in the high voltage power supply, the capacitance within the product reservoir and an estimate of the stray device capacitance) in about 5 seconds or less would require a bleeder resistor having a resistance of no more than about a 10 GΩ resistor.

$$R_B = 5.0 \text{ sec}/500 \text{ pF} = 10 \text{ G}\Omega$$

Depending upon the distribution of the capacitance (within voltage multiplier 130, the product reservoir capacitance and other stray capacitance) the 10 GΩ resistor, although dissipating at least 63% of the stored capacitance, may not in practice always eliminate the after-spray condition. Therefore, to ensure that 100% of the device capacitance is drained in the same 5 second interval the resistance of the bleeder resistor 160 would need to be no more than about 2 GΩ.

$$R_B = (5.0 \text{ sec}/500 \text{ pF})/5 = 2 \text{ G}\Omega$$

In at least one embodiment, for example, bleeder resistor 160 could be a high voltage resistor having a resistance of about 10 GΩ such as the high voltage resistor available from Nihon Hydrajinn Company available under the part number LM20S-M 10G.

Figure 2:
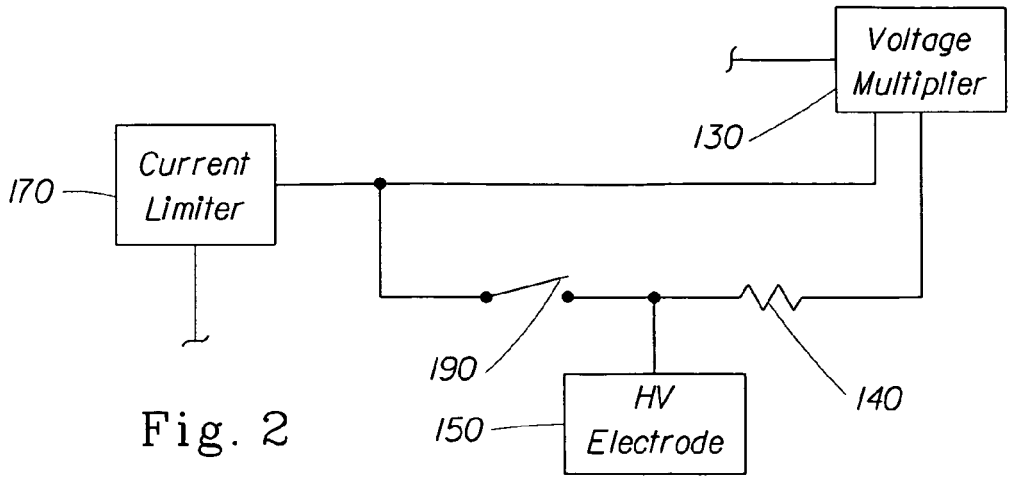
FIG. 2 is a schematic view of a portion the electrical circuitry of another embodiment of an electrostatic spray device of the present invention.

In another embodiment of this invention shown in FIG. 2, a mechanical switch 190 can be provided to reduce the effects of after-spray. The high voltage mechanical switch 190 performs a similar function as bleeder resistor 160 with the exception that the high voltage mechanical switch 190 is not an active circuit element during normal spraying operation. Rather, the mechanical switch is arranged so that during normal spraying operation the switch is in the open position and is not drawing any current. However, when the user intends to cease the spraying operation and de-energizes the device, the high voltage mechanical switch 190 is shifted from the open position to the closed position so that a conductive path exists between the output electrode directly to the grounded side of the device circuit, thereby providing a nearly instantaneous release for any stored charge within the device. One advantage of the high voltage mechanical switch 190 design is that the conductive path to ground does not need to include a resistor and allows for a faster discharge rate. Further, the conductive path is only available when the device is de-energized, i.e., in the off position, and does not interfere with normal spraying operation by draining energy from the high voltage electrode 150 and will not require the high voltage generating circuitry to generate excess power to compensate for power losses associated with the bleeder resistor 160.

Figure 3:
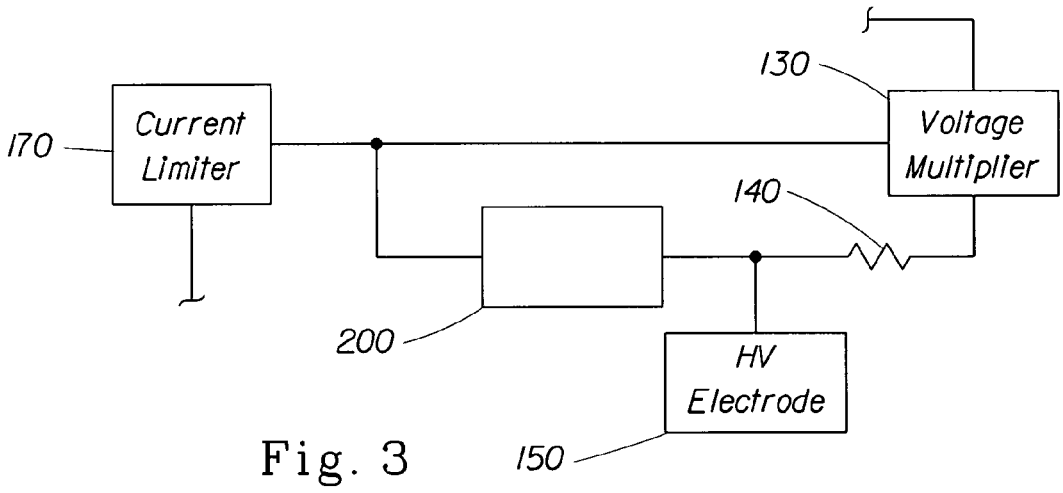
FIG. 3 is a schematic view of a portion the electrical circuitry of another embodiment of an electrostatic spray device of the present invention.

In yet another embodiment shown in FIG. 3, the device comprises a high voltage electrical switch 200, such as a transistor, in place of bleeder resistor 160 shown in FIG. 1. During normal spraying operation, the switch is in the open position and the conductive path to a point of lower potential of the circuitry is not active. However, upon the operator de-energizing the device, the switch is closed and the conductive path to a point of the circuit having a lower potential is then available to drain the stored charge in the device. Again, the high voltage electrical switch 200 can provide a lower resistance than the bleeder resistor 160 and, thus, allows for a quicker discharge of the stored charge in the device. The high voltage electrical switch 200 further provides a conductive path that is only available when the device is de-energized, i.e., in the off position, and does not interfere with normal spraying operation by draining energy from the high voltage electrode 150 and will not require the high voltage generating circuitry to generate excess power to compensate for power losses associated with the bleeder resistor 160.

Figure 4:
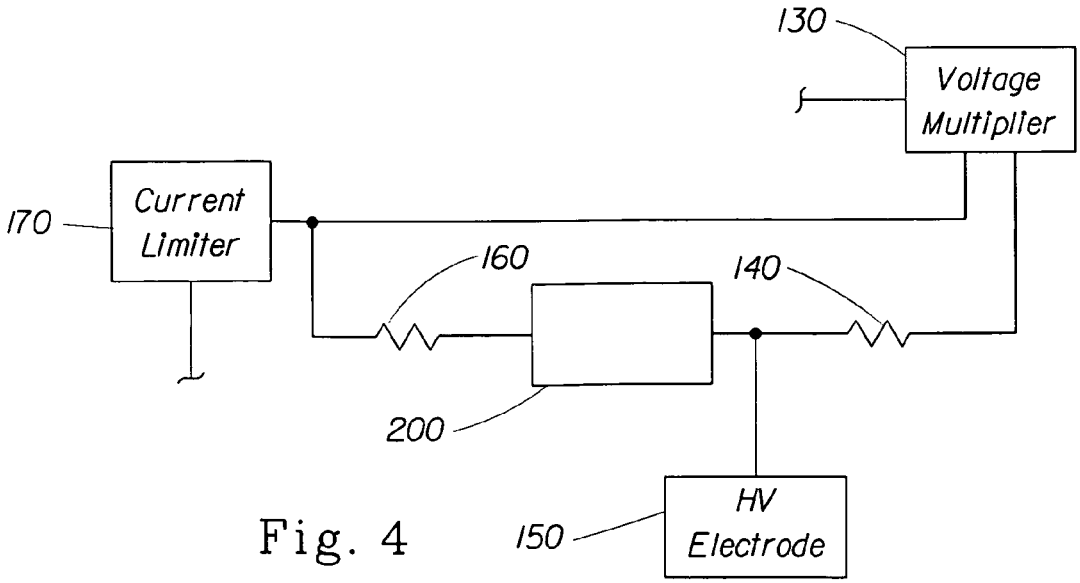
FIG. 4 is a schematic view of a portion the electrical circuitry of another embodiment of an electrostatic spray device of the present invention.
Figure 5:
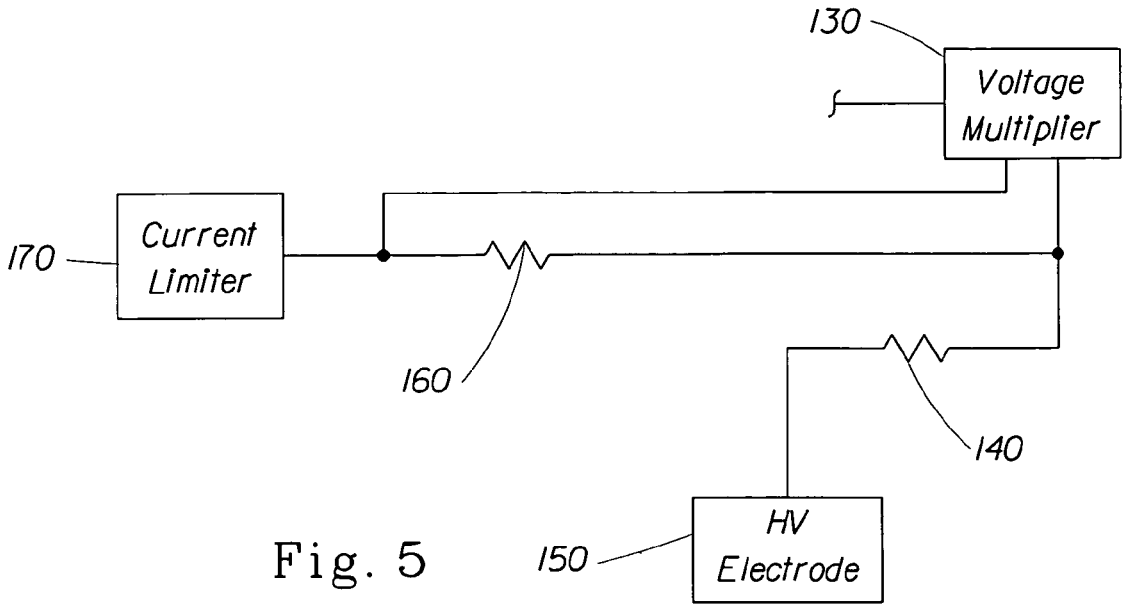
FIG. 5 is a schematic view of a portion the electrical circuitry of another embodiment of an electrostatic spray device of the present invention.

One skilled in the art may appreciate that either of the arrangements shown in FIG. 2 or FIG. 3 may also include a bleeder resistor 160 such as shown in FIG. 4. In some cases it may be desirable to control the rate at which the stored capacitance is discharged. In such a case, the bleeder resistor 160 can be connected to either the high voltage mechanical switch 190 or the high voltage electrical switch 200 as shown in FIG. 4. Further, one skilled in the art will also recognize that a bleeder resistor and/or mechanical or electrical switches may be arranged in other configurations. For example, FIG. 5 shows one alternative configuration in which the bleeder resistor 160 is connected between the voltage multiplier 130 and the current limiting resistor 170 and a point at a lower potential.

In yet another aspect of this invention, a power indicator 40, such as shown in FIG. 1, can provide a visual or other indication to signal the user of the device that the device has sufficient life in its batteries to deliver target quality spray. A typical problem with existing electrostatic spraying devices is the poor performance that develops as the voltage level of the batteries or other power supply decays over extended use. As the available current from the batteries drops, the voltage generated at the high voltage electrode 150 and the speed of the motor 60 decrease at different rates. This can cause a deviation from the target charge-to-mass ratio and can result in a below-target spray quality. An electrostatic spray device of the present invention can include a circuit that monitors the voltage of the battery, informs the user of the present battery status and shuts down the device when the battery voltage drops below a predetermined level in order to prevent the device from providing a below-target spray quality.

In one embodiment, the power indicator 40 can be an LED, such as an LED that emits a light in the orange range of the electromagnetic (EM) spectrum when the batteries are within the nominal or target operating voltage range. The signal to the power indicator 40 can be fed from an op-amp within the DC/DC converter 30 that compares the incoming signal from power source 10, e.g., batteries, with a preset reference signal. When the voltage of the power source reaches a predetermined level that corresponds to a predetermined quantity of usable battery life remaining such as five percent, the DC/DC converter 30 may provide a signal to power indicator 40 that changes the indication status of the indicator, e.g., turn the LED on or off, to indicate that the batteries need replacing. This will allow the user to change the batteries before the voltage level drops to a level that could provide below-target spray quality or that could cause the device to fail to perform during the application process and leave the user with a partially finished application. Further, the circuit can shut down the device at a predetermined battery voltage to ensure that poor spray performance is not experienced by the user due to depleted batteries. In one embodiment, for example, the circuit can give the user at least enough time to complete one complete product application after the power indicator 40 has indicated that the batteries need to be replaced before shutting down the device.

Having shown and described the preferred embodiments of the present invention, further adaptations of the present invention as described herein can be accomplished by appropriate modifications by one of ordinary skill in the art without departing from the scope of the present invention. Several of these potential modifications and alternatives have been mentioned, and others will be apparent to those skilled in the art. For example, while exemplary embodiments of the present invention have been discussed for illustrative purposes, it should be understood that the elements described will be constantly updated and improved by technological advances. Accordingly, the scope of the present invention should be considered in terms of the following claims and is understood not to be limited to the details of structure, operation or process steps as shown and described in the specification and drawings.

INCORPORATION BY REFERENCE

Relevant electrostatic spray devices and cartridges are described in the following commonly-assigned, concurrently-filed U.S. patent applications, and hereby incorporated by reference:

"Electrostatic Spray Device", which is assigned 09/795551.

"Electrostatic Spray Device", which is assigned 09/759550

"Disposable Cartridge For Electrostatic Spray Device", which is assigned 09/759549

What is claimed is:

1. An electrostatic spraying device structured to deliver a product from a reservoir through a channel to a point of dispersal, to electrostatically charge the product via a high power electrode after the product has exited the reservoir and to dispense the product from an exit orifice of a nozzle to the skin of a user, wherein said device comprises:

a power source to supply an electrical charge;

a high voltage power supply electrically connected to said power source to charge the high voltage electrode and to supply a variable output signal in response to a feedback signal; and a high voltage resistor with a resistance value "R" in ohms "Ω", electrically connected to an output of the high voltage power supply where "R" is in the range of 1 MΩ and 100 GΩ.

2. The electrostatic spraying device of claim 1, wherein said feedback signal monitor: a voltage level at said high voltage electrode.

3. The electrostatic spraying device of claim 1, wherein said feedback signal monitors a voltage level within said high voltage power supply.

4. The electrostatic spraying device of claim 3, wherein said feedback signal monitors a voltage level at a primary coil of a high voltage transformer.

5. The electrostatic spraying device of claim 3, wherein said feedback signal monitors a voltage level at a storage capacitor within said high voltage power supply.

6. The electrostatic spraying device of claim 1, wherein said high voltage power supply alters a current level supplied through said high voltage power supply in response to said feedback signal.

7. The electrostatic spraying device of claim 1, wherein said high voltage power supply varies said output by varying a frequency of a control signal of a DC/DC converter of said high voltage power supply.

8. The electrostatic spraying device of claim 1, wherein said high voltage power supply adjusts said output signal of said high voltage power supply in response to a change in a flow rate of the product.

9. The electrostatic spraying device of claim 1, wherein said high voltage power supply is encased in a sealant.

10. The electrostatic spraying device of claim 1, further comprising a moisture-proof barrier for sealing the device.

11. The electrostatic spraying device of claim 1, wherein said high voltage resistor has a resistance selected such that said resistor is capable to drain said stored charge of the high voltage power supply in less than about 20 seconds after said high voltage power supply is deactivated.

12. The electrostatic spraying device of claim 1, further comprising a high voltage resistor electrically connected to the said high voltage electrode to drain a stored charge of the high voltage power supply.

13. The electrostatic spraying device of claim 1, further comprising a mechanical switch configured to drain a stored charge of the high voltage power supply when said high voltage power supply is deactivated.

14. The electrostatic spraying device of claim 1, further comprising an electrical mechanical switch configured to drain a stored charge of the high voltage power supply when said high voltage power supply is deactivated.

15. An electrostatic spraying device structured to deliver a product from a reservoir through a channel to a point of dispersal, to electrostatically charge the product via a high power electrode after the product has exited the reservoir and to dispense the product from an exit orifice of a nozzle to the skin of a user, wherein said device comprises:

a power source to supply an electrical charge;

a high voltage power supply electrically connected to said power source to charge the high voltage electrode and to supply a variable output signal in response to a feedback signal; and a high voltage resistor with a resistance value "R" in ohms "Ω", electrically connected to an output of the high voltage power supply where "R" is in the range of 500 MΩ and 50 GΩ.

16. An electrostatic spraying device structured to deliver a product from a reservoir through channel to a point of dispersal, to electrostatically charge the product via a high power electrode after the product has exited the reservoir and to dispense the product from an exit orifice of a nozzle to the skin of a user, wherein said device comprises:

a power source to supply an electrical charge;

a high voltage power supply electrically connected to said power source to charge the high voltage electrode and to supply a variable output signal in response to a feedback signal; and a high voltage resistor with a resistance value "R" in ohms "Ω", electrically connected to an output of the high voltage power supply where "R" is in the range of 1 GΩ and 20 GΩ.

* * * * *

UNITED STATES PATENT AND TRADEMARK OFFICE

CERTIFICATE OF CORRECTION

PATENT NO. : 7,712,687 B2
APPLICATION NO. : 09/759552
DATED : May 11, 2010
INVENTOR(S) : David Edward Wilson et al.

It is certified that error appears in the above-identified patent and that said Letters Patent is hereby corrected as shown below:

In the Claims

Column 12, Line 38, Claim 2
Delete "monitor:", insert --monitors--.

Column 14, Line 6, Claim 16
Delete "through channel", insert --through a channel--.

Signed and Sealed this
Seventeenth Day of May, 2016

Michelle K. Lee

Michelle K. Lee
*Director of the United States Patent and Trademark Office*